US007819206B2

(12) United States Patent
Peter

(10) Patent No.: US 7,819,206 B2
(45) Date of Patent: Oct. 26, 2010

(54) SYSTEM AND METHOD FOR LOGGING WITH WIRED DRILLPIPE

(75) Inventor: Andreas Peter, Niedersachsen (DE)

(73) Assignee: Baker Hughes Corporation, Houston, TX (US)

( * ) Notice: Subject to any disclaimer, the term of this patent is extended or adjusted under 35 U.S.C. 154(b) by 356 days.

(21) Appl. No.: 11/777,672

(22) Filed: Jul. 13, 2007

(65) Prior Publication Data

US 2009/0014175 A1 Jan. 15, 2009

(51) Int. Cl.
*E21B 47/01* (2006.01)

(52) U.S. Cl. ..... 175/50; 166/254.2; 340/855.1

(58) Field of Classification Search ..... 166/254.2; 175/50; 340/855.1
See application file for complete search history.

(56) References Cited

U.S. PATENT DOCUMENTS

| | | | | |
|---|---|---|---|---|
| 7,053,788 | B2 | 5/2006 | Hall et al. | |
| 7,535,377 | B2 * | 5/2009 | Hall et al. | 340/854.8 |
| 2005/0194187 | A1 | 9/2005 | Gleitman et al. | |
| 2007/0030167 | A1 * | 2/2007 | Li et al. | 340/855.1 |
| 2007/0159351 | A1 | 7/2007 | Madhavan et al. | |

FOREIGN PATENT DOCUMENTS

| | | |
|---|---|---|
| GB | 2 419 903 | 5/2006 |
| WO | 2007016687 | 2/2007 |

OTHER PUBLICATIONS

Hernandez, M., et al.; "High-Speed Wired Drillstring Telemetry Network Delivers Increased Safety, Efficiency, Reliability and Productivity to the Drilling Industry"; SPE113157; Presented at the 2008 Indian Oil and Gas Technical Conference, Mumbai, India; Mar. 4-6, 2008; 14 Pgs.

Frederics, Paul, et al.; "Successful Implementation of First Closed Loop, Multiservice Control System for Automated Pressure Management in a Shallow Gas Well Offshore Myanmar"; SPE112651PP; Presented at the 2008 IADC/SPE Drilling Conference Held in Orlando, Florida; Mar. 4-6, 2008; 17 Pgs.

Formation Evaluation Services; Baker Hughes Services Catalog; Version 2.0; May 2008; 30 Pgs.

Formation Testing and Sampling Services; Baker Hughes Services Catalog; Version 2.0; May 2008; 10 Pgs.

International Search Report with Written Opinion, PCT/US2008/069796, Date Mailed Nov. 7, 2008, Search report having 8 pages, Written Opinion having 7 pages.

* cited by examiner

*Primary Examiner*—William P Neuder
(74) *Attorney, Agent, or Firm*—Cantor Colburn LLP

(57) ABSTRACT

A system for logging with wired drill pipe includes a logging tool string; an interface sub in operable communication with the logging tool string; and a wired pipe in operable communication with the interface sub and method for logging with wired drill pipe.

32 Claims, 3 Drawing Sheets

SYSTEM AND METHOD FOR LOGGING WITH WIRED DRILLPIPE

BACKGROUND

In connection with the exploration for and recovery of hydrocarbons from a subterranean environment, it is generally useful to have information about the constitution of the various formations through which a borehole is drilled. Gaining information of this type is commonly achieved by using various logging devices. In general, logging devices are run in the hole on wireline in order to provide both power and signal conduits from a surface location to the logging device.

SUMMARY

A system for logging with wired drill pipe includes a logging tool string; an interface sub in operable communication with the logging tool string; and a wired pipe in operable communication with the interface sub.

A method for connecting a wired drillpipe to a wireline logging tool string includes mechanically and electrically connecting a wireline logging tool string to an interface sub; mechanically and electrically connecting the interface sub to a wired drillpipe; and Transmitting data signals through the wired drillpipe between the interface sub and a remote location.

BRIEF DESCRIPTION OF THE DRAWINGS

The following descriptions should not be considered limiting in any way. With reference to the accompanying drawings, like elements are numbered alike.

DETAILED DESCRIPTION

Several different types of logging tools are utilized in hydrocarbon industry each of which requires the use of a wireline and a wireline surface unit (not shown). Although wired pipe is known from such sources as Intelliserve, power is not conveyed by wired pipe that is commonly commercially available because the conductors are generally small and often commonly, the connection is not an electrical connection between the drill pipe joints but an inductive connection, which necessarily limits signal strength to data only. Such situation renders the use of wireline run logging tools impossible on wired pipe.

Figure 1:
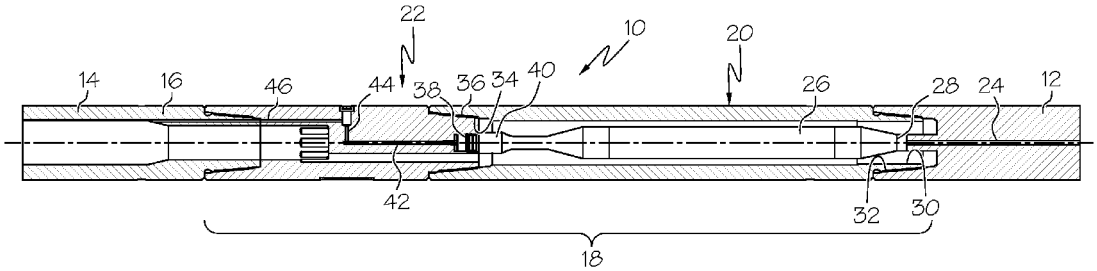
FIG. 1 is a cross-sectional schematic view of the wired drill pipe connected through an interface sub arrangement to a logging device utilizing surface power in accordance with the teaching hereof.

Referring to FIG. 1, a schematic representation of a wireline logging system 10 is provided. The system 10 comprises a wireline logging tool string 12 in operable communication with a wired pipe 14. One of ordinary skill in the art will recognize wired pipe 12 at the left most edge of the drawing and will note conductor 16 embedded therein. Tool string 12 and wired pipe 14 are generally incompatible with one another as noted above. As illustrated in FIG. 1, however, operable communication between tool string 12 and wired pipe 14 is provided by an interface sub 18. The reader will note that interface sub 18 is broken down into two subcomponents: interface electronics sub 20 and interface connection sub 22. Interface sub 18 is broken down as such for manufacturing purposes as opposed to any structural requirement.

A standard connection site 24 for tool string 12 is positioned axially of the tool and in one embodiment as shown is positioned in the center thereof. Therefore, any electronics module 26 is mounted within interface electronics sub 20 such that a connector 28 of the electronics module 26 is positioned axially (e.g. in the center) of the interface sub 18 in order to promote conductivity with standard connection site 24 of tool string 12. The electronics module 26 in this embodiment functions both to convey data signals both uphole and downhole as well as to transform a power signal from the surface which most commonly will be conveyed as a high-voltage/low-amperage signal over the wired pipe 14 due to conductor gauge in the wired pipe. This signal will then be transformed in the electronics module 26 to a higher amperage/lower voltage signal. Interface electronics sub 20 is otherwise connected to tool string 12 at a pin thread 30 of sub 20 engaged with a box thread 32 of tool string 12. An opposite end of sub 20 supports a box thread 34 and is connected at this location to a pin thread 36 of interface connection sub 22. Interface connection sub 22 further includes an electrical connector 38 electrically connected to the electronics module 26 at connection 40. While the connector 38 and connection 40 are illustrated at the axial centerline of the system 10, it is not required that these be at the axial centerline but could be offset, if desired. If these connectors were to be offset toward particular application, then the electronics module 26 would need to be constructed in such a way as to remain axially positioned such as illustrated with the connector 28 remains in the axial centerline, in order to promote conductivity with standard connection site 24.

Still referring to interface connection sub 22, it will be appreciated that a signal conduit 42 extends axially of the sub 22 to intersect a radial spur conduit 44 which itself is interconnected with wired pipe connection conduit 46. Interconnectivity then from wired pipe 14 to connector 38 is provided through the sub 22. It is to be appreciated that while in one embodiment the conduits 42, 44 and 46 are configured as electrical conduits, optical or other conduits are contemplated within the scope of this disclosure.

In this embodiment of the system it is noted that a direct electrical connection (or optical connection, for example) is achieved at wired pipe 14. This is accomplished in one embodiment by a galvanic contact between conduit 16 and conduit 46 in the shoulder of the pin of wired pipe 14. The wire of conduit 16 is heavier than about 20 AWG to convey sufficient electrical energy from the surface to the interface sub. Because of this configuration, it is possible to deliver power to tool string 12 through the wired pipe.

Benefits of the embodiment described include elimination of the wireline surface unit, and easy conveyance of wireline logging tools to far-reaching, high inclination targets.

In a second embodiment, many of the components described hereinabove remain the same. These will not be reiterated in discussion of FIG. 2. Rather, FIG. 2 discussions will be limited to those components that are distinct from the embodiment of FIG. 1, to provide clarity. Most notably in FIG. 2, power is not delivered to the tool string 12 from the surface, but rather is delivered to the tool string 12 from a schematically represented box 50 (in this embodiment intended to represent a battery) that is, in this embodiment, integrated with the electronics module 26. Because power is supplied to tool string 12 by the battery 50, it is not necessary that a direct electrical (or optical) connection be provided at wired pipe 14 but rather a more easily affected inductive coupling 52 can be used (see FIGS. 4 and 5).

Figure 2:
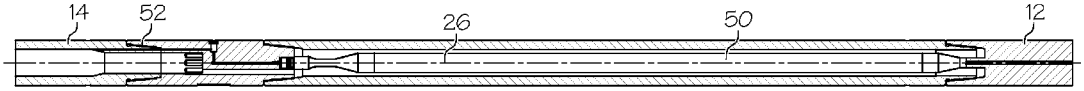
FIG. 2 is a cross-sectional schematic view of the wired drill pipe connected through an interface sub arrangement to a logging device utilizing battery power or fuel cell power in accordance with the teaching hereof.

In a third embodiment, and still referring to FIG. 2, the box 50 is now intended to represent a fuel cell and tank arrangement. The tank may for example contain hydrogen and oxygen. The reaction of these elements within the fuel cell is used to generate electrical power for supplying the wireline logging tool string.

In a fourth embodiment of the system 10, power supply to tool string 12 is provided by a mud turbine and alternator arrangement. The mud turbine, responsive to mud or other fluid movement therepast causes the alternator or other generator arrangement to rotate, thereby generating a power signal that can be utilized in generated form or can be rectified if desired for a particular application. It will be noted that the wired pipe 14 and the interface connection sub are unchanged from the FIG. 1 embodiment but that the electronics sub 20 has been relatively significantly modified and is identified in FIG. 3 as numeral 120. Electronics sub 120, in the FIG. 3 embodiment, includes a mud turbine 122 disposed and unity about centerline of the electronics sub 120 which is responsive to all fluids including mud circulated down within the wellbore and passing through ports 124. It will be appreciated that the mud turbine 122 can be configured to spool-up due to fluids moving uphole (to the left of the drawing) or to fluids moving downhole (toward the right of the drawing) depending upon the angle of turbine blades 126, which extend from a rotor hub 128 of the turbine 122. Although a turbine with two stages is shown, a single stage turbine, or a turbine with more stages could be used without departing from the scope of the invention. As will be evident to one of ordinary skill in the art, ports 124 by themselves are not sufficient to create a flow from uphole or downhole of the tool. Rather, another opening is required at an opposite end of the electronics sub 120. This opening is provided as channel 130 located within connection sub 22.

Figure 4:
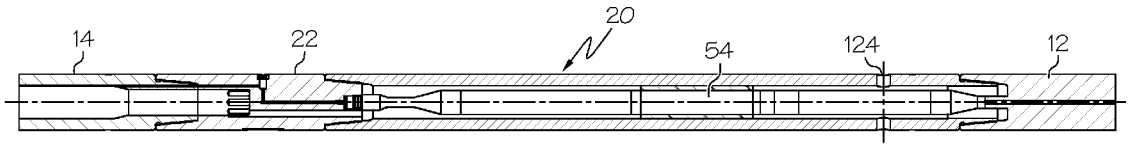
FIG. 4 is a cross-sectional schematic view of the wired drill pipe connected through an interface sub arrangement to a logging device utilizing positive displacement mud motor power in accordance with the teaching hereof.

In yet another embodiment, referring to FIG. 4, a small mud driven positive displacement motor 54, driving an alternator provides the required power to the toolstring 12. Such motors are commonly used to rotate drill bits, but can be adapted to this application by using the rotary motion created to rotate an alternator similarly to the turbine embodiment.

Figure 5:
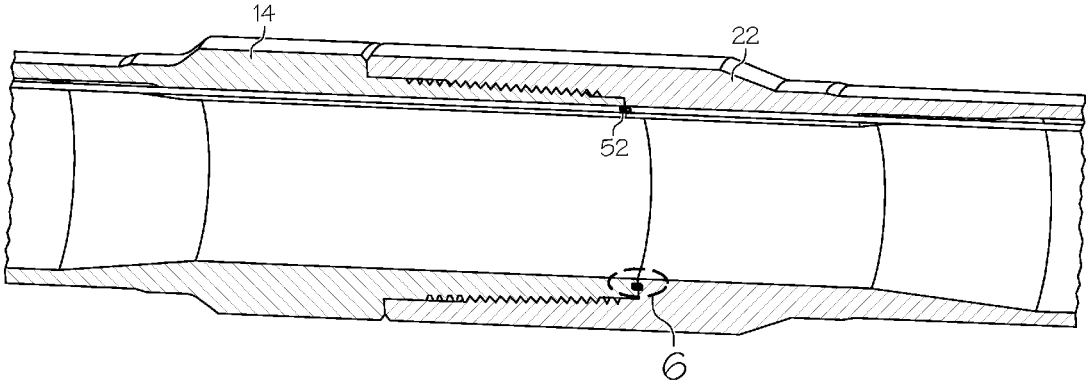
FIG. 5 is a schematic representation of a prior art wired pipe joint with an inductive connection.
Figure 6:
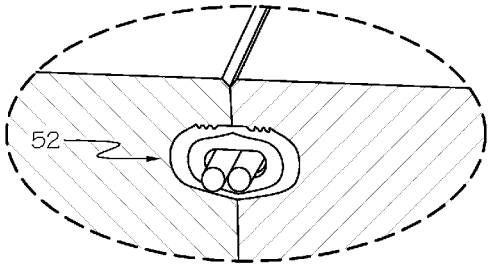
FIG. 6 is an enlarged view of a portion of FIG. 5 illustrating the inductive connection.

This embodiment, as well as the second, third and fourth embodiments, does not require wired pipe 14 to carry power and thus it is possible in this embodiment to utilize an inductive coupling 52 as shown in FIGS. 2, 5 and 6. It is of course also possible to employ a direct electrical connection or optical connection. For clarity of understanding, FIGS. 5 and 6 are provided to show the location and appearance of inductive coupling 52.

Figure 3:
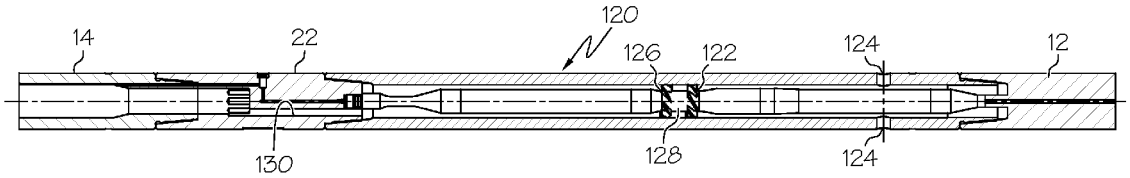
FIG. 3 is a cross-sectional schematic view of the wired drill pipe connected through an interface sub arrangement to a logging device utilizing mud turbine power in accordance with the teaching hereof.

In the embodiment of FIG. 3, therefore, the only signal that needs to be transmitted up or down the wired pipe is data and all power to the tool string 12 is generated in the electronics sub and directly supplied to the tool string.

While the invention has been described with reference to an exemplary embodiment or embodiments, it will be understood by those skilled in the art that various changes may be made and equivalents may be substituted for elements thereof without departing from the scope of the invention.

The invention claimed is:

1. A system for logging with wired drill pipe comprising:
a wireline logging tool string;
an interface sub in operable communication with the wireline logging tool string; and
a wired pipe in operable communication with the interface sub, the interface sub being configured to pass power between the wired pipe and the wireline logging tool string.

2. The system as claimed in claim 1 wherein the interface sub comprises an electronics sub and an interface connection sub.

3. The system as claimed in claim 1 wherein the wireline logging tool string is both threadedly connected to the interface sub and signal connected to the interface sub.

4. The system as claimed in claim 1 wherein the interface sub and wired pipe are directly signal connected to pass both data and power signals.

5. The system as claimed in claim 4 wherein the connection is electrical.

6. The system as claimed in claim 4 wherein the connection is optical.

7. The system as claimed in claim 1 wherein the interface sub and wired pipe are indirectly signal connected to pass data.

8. The system as claimed in claim 7 wherein the interface sub and wired pipe are inductively connected.

9. The system as claimed in claim 1 wherein the interface sub adapts connection of a wired pipe with a radially displaced connection site to an axial connection site.

10. The system as claimed in claim 1 wherein the interface sub includes a signal conveying configuration.

11. The system as claimed in claim 1 wherein the interface sub includes an electronics module.

12. The system as claimed in claim 11 wherein the electronics module includes a transformer.

13. The system as claimed in claim 1 wherein the interface sub includes a battery.

14. The system as claimed in claim 13 wherein the battery feeds the wireline logging tool string with a power signal.

15. The system as claimed in claim 1 wherein the interface sub includes a fuel cell.

16. The system as claimed in claim 15 wherein the fuel cell feeds the wireline logging tool string with a power signal.

17. The system as claimed in claim 1 wherein the interface sub further includes a mud turbine.

18. The system as claimed in claim 17 wherein the mud turbine is in operable communication with a power generation configuration.

19. The system as claimed in claim 18 wherein the power generation configuration is an alternator.

20. The system as claimed in claim 17 wherein the interface sub further includes fluid ports facilitating fluid flow past the mud turbine.

21. The system as claimed in claim 1 wherein the interface sub further includes a positive displacement motor.

22. The system as claimed in claim 21 wherein the positive displacement motor is in operable communication with a power generation configuration.

23. The system as claimed in claim 22 wherein the power generation configuration is an alternator.

24. The system as claimed in claim 21 wherein the interface sub further includes fluid ports facilitating fluid flow through the positive displacement motor.

25. A method for connecting a wired drillpipe to a wireline logging tool string comprising:

mechanically and electrically connecting a wireline logging tool string to an interface sub;

mechanically and electrically connecting the interface sub to a wired drillpipe; and;

transmitting power between the wired drillpipe and the wireline logging tool string through the interface sub.

26. The method of claim 25, wherein the wireline logging tool string is electrically powered by a battery in the interface sub.

27. The method of claim 25, wherein the wireline logging tool string is electrically powered by a fuel cell in the interface sub.

28. The method of claim 25, wherein the wireline logging tool string is electrically powered by a mud flow driven turbine and alternator arrangement in the interface sub.

29. The method of claim 25, wherein the wireline logging tool string is electrically powered by a mud flow driven positive displacement motor and alternator arrangement in the interface sub.

30. The method of claim 25, further comprising transmitting data signals, acquired by the wireline logging tool string, through the interface sub, through the wired drillpipe, to the surface.

31. The method of claim 25, further comprising transmitting power signals through the wired pipe.

32. The method of claim 31, wherein the transmitting power signals is from the surface through the interface sub and to the logging tools string.

* * * * *